US007775280B2

(12) United States Patent
Rose

(10) Patent No.: US 7,775,280 B2
(45) Date of Patent: Aug. 17, 2010

(54) JARS FOR WELLBORE OPERATIONS

(76) Inventor: Dwight Rose, 2708 Lawrence, Nederland, TX (US) 77627

( * ) Notice: Subject to any disclaimer, the term of this patent is extended or adjusted under 35 U.S.C. 154(b) by 126 days.

(21) Appl. No.: 11/983,979

(22) Filed: Nov. 13, 2007

(65) Prior Publication Data

US 2008/0149340 A1 Jun. 26, 2008

Related U.S. Application Data

(60) Provisional application No. 60/858,208, filed on Nov. 10, 2006.

(51) Int. Cl.
*E21B 31/107* (2006.01)

(52) U.S. Cl. ..... 166/301; 166/178

(58) Field of Classification Search ..... 166/178, 166/301; 175/414, 93, 299
See application file for complete search history.

(56) References Cited

U.S. PATENT DOCUMENTS 4,333,542 A * 6/1982 Taylor ..... 175/299
5,103,903 A * 4/1992 Marks, II ..... 166/178
5,156,211 A 10/1992 Wyatt
6,290,004 B1 9/2001 Evans
6,866,096 B2 3/2005 Tillett, Jr.
6,896,060 B2 5/2005 Tillett, Jr.
7,111,678 B2 9/2006 McElroy et al.
7,267,176 B2 * 9/2007 Madden ..... 166/301
2001/0018974 A1 * 9/2001 Mouton et al. ..... 166/301

* cited by examiner

*Primary Examiner*—David J Bagnell
*Assistant Examiner*—James G Sayre
(74) *Attorney, Agent, or Firm*—Winstead PC

(57) ABSTRACT

An example of an apparatus for jarring a wellbore tool from an obstruction includes four sub-assemblies in communication with three springs such that the springs may be compressed forcing the subassemblies to become adjacent to one another. When the springs are actuated, the sub-assembly units spring apart from one another force dislodging the lower most sub-assembly component from the obstruction.

1 Claim, 3 Drawing Sheets

JARS FOR WELLBORE OPERATIONS

RELATED APPLICATIONS

This application claims the benefit of U.S. Provisional Patent Application No. 60/858,208 filed on Nov. 10, 2006.

FIELD OF THE INVENTION

The apparatus and method of the present invention relate in general to wellbore operations and more specifically to an apparatus and method for jarring of a stuck wireline deployed tool used in downhole wellbores.

BACKGROUND

When logging wells for the discovery of hydrocarbons wellbore tools are often deployed on cable, including wireline, slick line, and electric wireline. A common problem that occurs in these operations is that the tool gets stuck in the wellbore by running into a restriction in the wellbore called a "squeeze", an area where the wellbore has collapsed either from formation pressure forcing the well walls to collapse, or from debris sluffing off the well walls causing blockage called a "bridge". The tool can be freed by jarring the tool in an upward direction because there is no debris or restriction above the tool. When the tool becomes free it can be worked up and down to get the tool through the restriction, this is called "spudding". If the spudding operation is successful, the tool can pass the restriction and continue to run downhole to complete the of the well.

When the logging is completed, the tool can become stuck when it is being pulled out of the wellbore. Sometimes the tool can be jarred upward pulling it through the restriction and sometimes it does not come free because the squeeze or bridge is too large or heavy.

If the tool becomes permanently stuck the options are to electrically burn off the weak point of the tool or pull off the weak point of the tool and do a fishing trip to retrieve the lost tool. Prior to pulling off or burning the weak point if a downward force could be applied to the tool to move it down out of the restriction the tool could be worked up and down to spud the tool up through the restriction the same way spudding the tool to get it through the restriction while running downhole.

Therefore, it is a desire of the present invention to provide a method and apparatus for freeing a wireline deployed tool by jarring in a downward direction.

SUMMARY OF THE INVENTION

An example of a wellbore jar includes a first sub-assembly with an upper member secured the lower end of a wireline, a second sub-assembly positioned lower than the first sub-assembly and attached to the first sub-assembly. The second sub-assembly also includes a first housing, a shaft and a first spring, wherein the shaft and the spring are inside the first housing. The wellbore jar also includes a third sub-assembly including a second housing and second spring arrangement, in communication with the second sub-assembly. The wellbore assembly also includes a fourth sub-assembly attached to the third sub-assembly and also attached to a down hole tool. The fourth sub-assembly further including a third housing, and a third spring; wherein the first, second and third string are capable of storing compressive energy. The wellbore assembly also includes an actuator for releasing the stored energy in the first, second and third springs downward onto the tool.

An example of a method of dislodging a stuck tool downhole is disclosed. The method includes the steps of providing a jarring apparatus above the stuck tool. The jarring apparatus has a first, second, third and fourth sub-assembly in communication with each other. The upper end of the first sub-assembly is attached to a wireline, which imparts an upward force on the first, second and third sub-assemblies by pulling the wireline towards the surface of the well. Compressing a first, and second spring located in the second and third sub-assemblies then releasing the compressed force stored within the second and third sub-assembly downward against the fourth sub-assembly attached to the stuck tool sufficient to dislodge the stuck tool, with an imparting force on the tool attached to the upper end of the first sub-assembly.

Another example of a wellbore jar for dislodging tools downhole is disclosed. The wellbore jar includes: a first attachment means for attaching to the upper end of the apparatus to a wireline cable. There is also a second attachment means for attaching to the upper end of the tool to the lower end of the apparatus and a spring mechanism within the apparatus for storing compressional force as the length of wireline above the apparatus applies upward force on the apparatus. Also present is an actuating means for rapidly releasing the stored compressional force downward onto the tool lodged downhole.

The foregoing has outlined some of the features and technical advantages of the present invention in order that a detailed description of an example of the invention that follows may be better understood. Additional features and advantages of the invention will be described hereinafter which form the subject of the claims of the invention.

BRIEF DESCRIPTION OF THE DRAWINGS

The foregoing and other features and aspects of the wellbore jar will be best understood with reference to the following detailed description of a specific embodiments of the invention, when read in conjunction with the accompanying drawings, wherein.

DETAILED DESCRIPTION

Figure 1A:
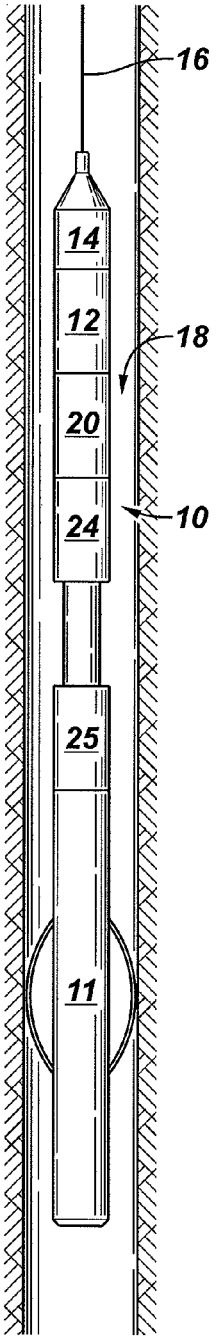
FIGS. 1A-1D illustrate an example of the apparatus in operation.

Refer now to the drawings wherein depicted elements are not necessarily shown to scale and wherein like or similar elements are designated by the same reference numeral through the several views.

As used herein, the terms "up" and "down"; "upper" and "lower"; "uphole" and "downhole"; and other like terms indicating relative positions to a given point or element are utilized to more clearly describe some elements of the embodiments of the invention. Commonly, the terms "up," "upper," "uphole," and other like terms are meant to indicate a position that is closer to the surface along the linear distance of the borehole. It is noted that through the use of directional drilling, a wellbore may not extend straight up and down. Thus these terms describe relative positions along the wellbore.

FIG. 1A provides an example of the present invention. Apparatus 10 includes four principal sub-assemblies attached to a tool 11 located in a wellbore 18. First sub-assembly 12 includes an upper member 14 secured to the lower end of wireline 16. Second sub-assembly 20 is lower than first sub-assembly 12 and is attached to first sub-assembly 12. Third sub-assembly 24 is a tube and spring arrangement, in communication with second sub-assembly 20 and the fourth sub-assembly 25. Fourth sub-assembly 25 is attached to third sub-assembly 24 and is also attached to the down hole tool. Wellbore 18, as illustrated, is free of any squeezes or impediments.

Figure 1B:
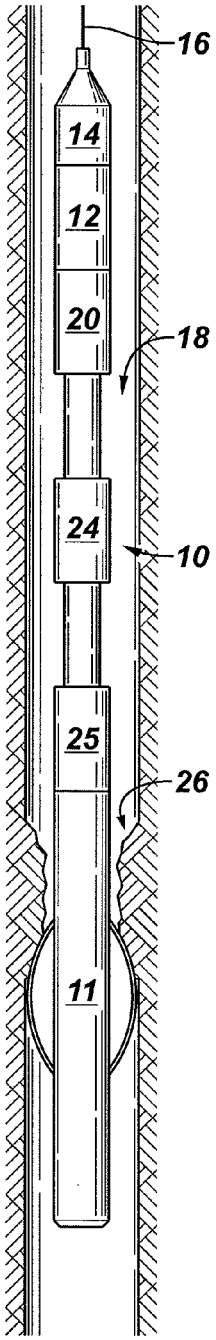

FIG. 1B illustrates tool 11 stuck below obstruction 26. An end user located topside to the wellbore 18, would know of the blockage caused by obstruction 26 as the wireline 16 would no longer be moved upward in the wellbore. Apparatus 10 will then be fully extended showing the intersections between sub-assemblies 12, 20, and 24. During this time none of the springs in sub-assemblies 12, 20, and 24 are constricted and the springs do not store any spring energy. (See FIG. 2A-D for spring locations).

Figure 1C:
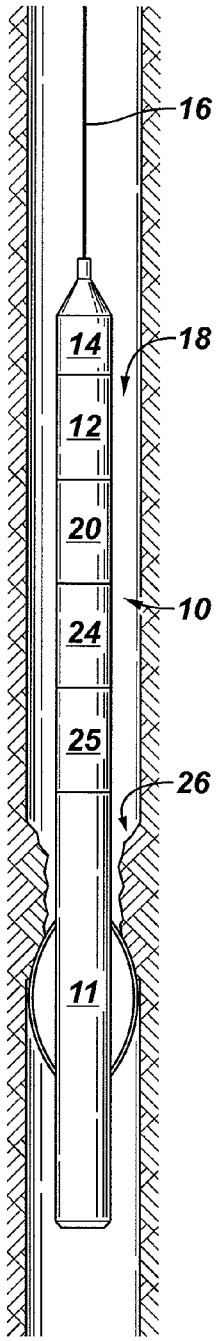

FIG. 1C illustrates the tension on wireline 16 being removed, whereby the weight of apparatus 10 will cause apparatus 10 to contract due to gravity. When apparatus 10 is contracted the springs located in sub-assemblies 12, 20 and 24 will contract storing compression energy. In the fully contracted state, apparatus 10 is primed and its internal springs tightened (FIGS. 2A-D). The energy stored in the springs is so great that third sub-assembly 24 will have its internal spring activate.

Figure 1D:
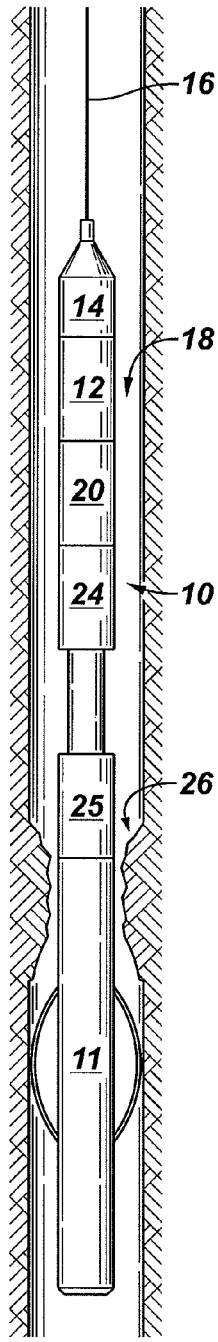

FIG. 1D provides an example of the present invention as shown in FIG. 1C except that in FIG. 1D third sub-assembly 24 has activated, therein dislodging fourth sub-assembly 25 from obstruction 26 due to a downward force. The weight of apparatus 10 must be greater than force holding apparatus 10 in obstruction 26, otherwise the discharge of the spring 54 in third sub-assembly 24 will cause the three sub-assemblies 12, 20 and 24 above obstruction 26 to move upward instead of forcing fourth sub-assembly 25 downward.

FIGS. 2A-D illustrate the sub-assemblies that make up an example of apparatus 10.

Figure 2A:
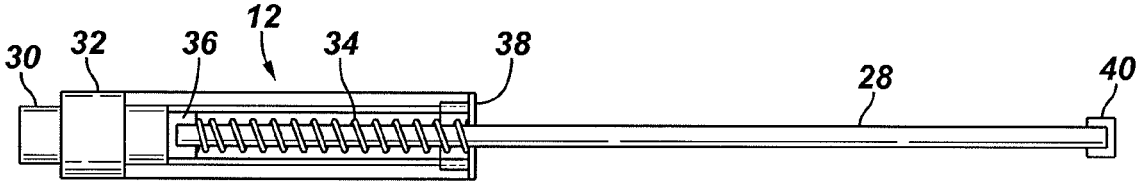
FIG. 2A is a partial cut away view of an example of a first sub-assembly of an apparatus in isolation.

FIG. 2A provides an example of first sub-assembly 12 in isolation. First sub-assembly 12 includes of shaft member 28, cap 30, housing 32, spring 34, threaded tube 36, split thread collar 38 and shaft cap 40. Cap 30 is attached to housing 32 such that a portion of cap 30 is housed in housing 32. The portion of cap 30 that is interior to housing 32 is threadably attached to threaded tube 36. Also threadably attached to threaded tube 36 is shaft member 28. A portion of shaft member 28 is inside of housing 32 and a portion is exterior to housing 32. The interior portion of shaft member 28 is positioned within spring 34. The portion of housing 32 that is opposite to cap 30 is threaded and joined with split thread collar 38. Shaft member 28 is also fitted with a shaft cap 40 which is opposite housing 32. Cap 30 is also constructed to attach to the lower end of wireline 16. Shaft member 28 of first sub-assembly 12 can be pulled upward to compress an internal spring 34.

Figure 2B:
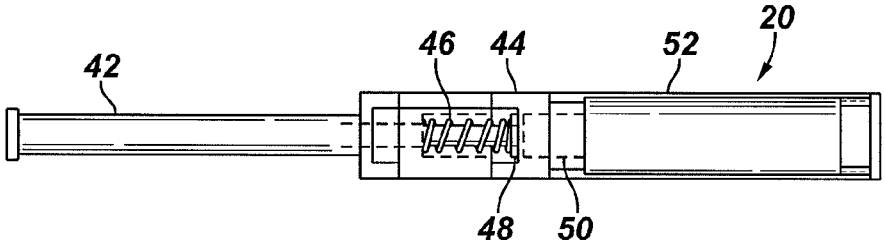
FIG. 2B is a partial cut away view of an example of a second sub-assembly of an apparatus in isolation.

FIG. 2B is a cross sectional view of the second sub-assembly 20 in isolation. Second sub-assembly 20 includes tube 42, housing 44, spring 46, cap 48, tube 50, and housing 52. Tube 42 is constructed so as to have shaft member 28 slideably move within housing 44. In effect, tube 42 acts as a piston wall with shaft member 28 capable of movement inside the piston. Tube 42 is threaded and attached to housing 44. Interior to housing 44 is another spring 46 which is constructed to fit around shaft member 28. Spring 46 is also buttressed with cap 48 with an opening. Cap 48 acts as a backstop for spring 46, but allows for movement of shaft member 28 through the opening. Also threadably attached to housing 44 is housing 52. Inside of housing 52 and threadably attached to housing 52 is tube 50.

Figure 2C:
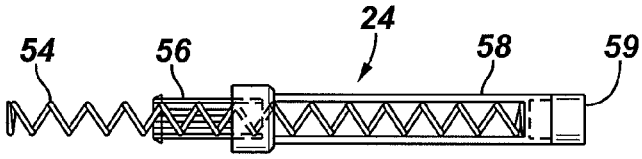
FIG. 2C is a partial cut away view of an example of a third sub-assembly of an apparatus in isolation.

FIG. 2C is a cross sectional view of third sub-assembly 24 in isolation. Third sub-assembly 24 includes a spring 54, hollow cap 56, and tube 58. Spring 54 is located inside of hollow cap 56, and tube 58. Tube 58 is threadably joined opposite hollow cap 56 with an additional hollow cap 59 such that hollow cap 59 is a backstop for spring 54. Although not illustrated, the use of latches associated with tube 58 of third sub-assembly 24 could be implemented to ensure that the springs 34 and 46 remain coiled prior to striking third sub-assembly 24 and releasing the compressed spring energy.

Figure 2D:
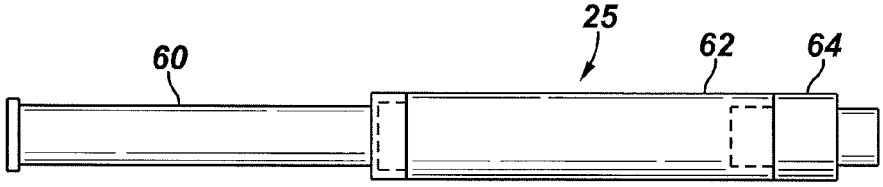
FIG. 2D is a partial cut away view of an example of a fourth sub-assembly of an apparatus in isolation.

FIG. 2D is a cross sectional view of fourth sub-assembly 25 in isolation. Fourth sub-assembly 25 includes a tube 60, a housing 62, and a cap 64. Tube 60 is designed to accommodate tube 58 of third sub-assembly 24 such tube 58 can slide into tube 60 similar to a piston. Fourth sub-assembly 25 also contains cap 64 which can act as the connection point of the lower end of apparatus 10 that connects to the upper end of tool 11.

Figure 3:
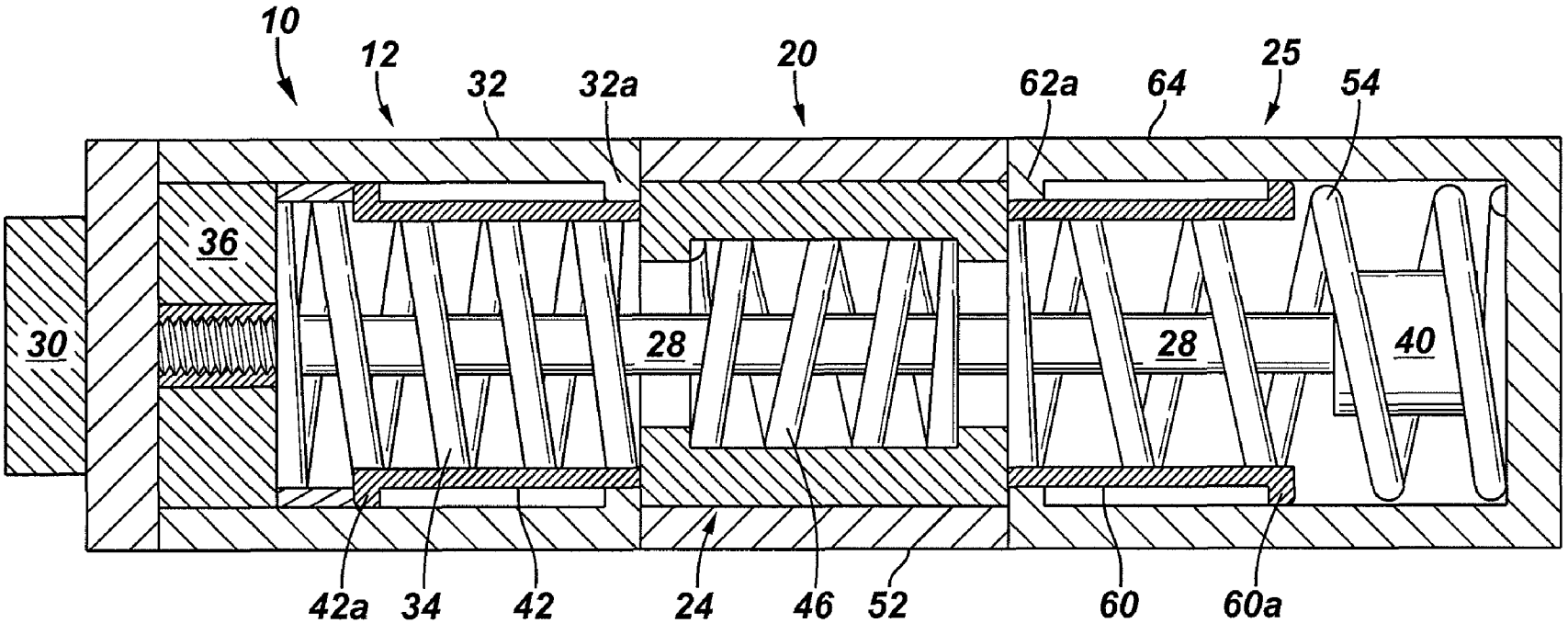
FIG. 3 is a partial cut away view of an example of the apparatus as it is compressed.

FIG. 3 is a cross sectional view of an example of apparatus 10 of the present invention, shown in a contracted or cocked position. When the tension on wireline 16 is released first sub-assembly 12, spring 34 between sub-assemblies 12 and 20 is compressed. The weight of sub-assemblies 12 and 20 compress spring 54 between sub-assemblies 20 and 24. The impact of sub-assemblies 12 and 20 on sub-assembly 24 is sufficient to act as an actuator and to cause spring 54 to expend its stored spring energy and force fourth sub-assembly 25 downward, thereby dislodging fourth sub-assembly 25 from the obstruction 26. Housings 32 and 62 are constructed to have lips 32*a* and 62*a* respectively, which extend into the interior of the housings 32 and 62. Tubes 42 and 60 are constructed to have flanges 42*a* and 60*a* respectively which are designed to engage the lips 32*a* and 62*a* respectively so that tubes 42 and 60 will not extend past lips 32*a* and 62*a* when apparatus 10 is fully extended (FIG. 1B).

From the foregoing detailed description of specific examples of the apparatus, it should be apparent that a wellbore drilling system and method that is novel has been disclosed. Although specific examples have been disclosed herein in some detail, this has been done solely for the purposes of describing various features and aspects of the invention, and is not intended to be limiting with respect to the scope of the invention. It is contemplated that various substitutions, alterations, and/or modifications, including but not limited to those implementation variations which may have been suggested herein, may be made to the disclosed examples without departing from the spirit and scope of the invention as defined by the appended claims which follow.

What is claimed is:

1. A method of dislodging a tool stuck downhole in a wellbore, comprising:

connecting a jarring apparatus to a tool via a wireline, the jarring apparatus comprising a first sub-assembly disposing a first spring, a second sub-assembly disposing a second spring, a third sub-assembly disposing a third spring and a forth sub-assembly, wherein the first sub-assembly is attached to a wireline, the forth sub-assembly is attached to the tool and the second sub-assembly and the third sub-assembly are disposed between the first and the forth sub-assembly;

compressing the third spring in response to applying tension to the wireline moving the first sub-assembly, the second sub-assembly and the third sub-assembly away from the stuck tool;

moving the first sub-assembly, the second sub-assembly and the third sub-assembly toward the stuck tool in response to releasing the tension in the wireline;

compressing the first spring and the second spring in response to moving the first sub-assembly, the second sub-assembly, and the third sub-assembly the third tool toward the stuck tool;

expanding the third spring in response to compressing the first and the second springs; and jarring the stuck tool downward in response to the force of the expanding third spring and the impact of the first sub-assembly, the second sub-assembly and the third sub-assembly on the stuck tool via the forth sub-assembly.

* * * * *